United States Patent [19]

Wood

[11] Patent Number: 4,492,383

[45] Date of Patent: Jan. 8, 1985

[54] INFLATABLE WELL BORE PACKER WITH PRESSURE EQUALIZED RIB CAVITY

[75] Inventor: Edward T. Wood, Kingwood, Tex.

[73] Assignee: Completion Tool Company, Houston, Tex.

[21] Appl. No.: 587,918

[22] Filed: Mar. 9, 1984

Related U.S. Application Data

[63] Continuation of Ser. No. 470,199, Feb. 28, 1983, abandoned.

[51] Int. Cl.[3] ..... F16J 15/46; E21B 33/127

[52] U.S. Cl. ..... 277/34; 277/27; 277/30; 166/120; 166/187

[58] Field of Search ..... 277/3, 27, 30, 31, 34, 277/34.3, 34.6, 226, 230; 166/120, 122, 187, 196, 207, 212

[56] References Cited

U.S. PATENT DOCUMENTS

| | | | |
|---|---|---|---|
| 2,778,432 | 1/1957 | Allen | 166/187 |
| 3,085,628 | 4/1963 | Malone | 166/187 |
| 3,437,142 | 4/1969 | Conover | 277/34 X |
| 3,542,127 | 11/1970 | Malone | 166/122 |
| 3,604,732 | 9/1971 | Malone | 277/34 X |
| 3,837,947 | 9/1974 | Malone | 277/34 X |

*Primary Examiner*—Robert S. Ward

[57] ABSTRACT

An inflatable packer which includes a tubular mandrel with an inflatable sleeve position about and connected to the mandrel by a pair of axially spaced apart collars. The ends of the sleeve are reinforced by reinforcing sheaths which include a plurality of axially extending overlapping expansible ribs which are contained in spaced apart cavities formed adjacent the ends of the sleeve. Ports are provided for allowing well bore fluid to communicate with the cavities to equalize the pressure around and between the ribs so that well bore pressure does not prevent the ribs from expanding.

11 Claims, 3 Drawing Figures

INFLATABLE WELL BORE PACKER WITH PRESSURE EQUALIZED RIB CAVITY

This application is a continuation application of application Ser. No. 470,199, filed Feb. 28, 1983, now abandoned.

BACKGROUND OF THE INVENTION

1. Field of the Invention

The present invention relates generally to inflatable packers for use in oil and gas wells for providing annular seals between the outside of pipe and the surrounding surface of the borehole or casing, and more particularly to an inflatable packer having an expansible reinforcing sheath that is pressure and volume balanced with the well bore.

2. Description of the Prior Art

Inflatable packers of the type disclosed, for example, in U.S. Pat. No. 3,640,723 or U.S. Pat. No. 3,837,947, have been used for many years. Such packers include a tubular mandrel that is covered by inflatable sleeve secured to the mandrel by a pair of axially spaced apart end assemblies. Each end assembly includes a collar, which is adapted to be connected to the mandrel, and an annular head, which is connected at one end to the collar and at the other end to the sleeve. The sleeve is normally reinforced by an expansible reinforcing sheath, which comprises a plurality of overlapping ribs connected at each end to a head. A passage with valve means is provided in one of the collars for allowing the passage of fluid from inside the pipe string between the inflatable sleeve and the mandrel to inflate the sleeve into sealing contact with the well bore or casing. Such inflatable packers function to isolate the annulus above the packer from that below, and accordingly, need only be of a length long enough to form an effective seal.

More recently, there have been developed inflatable packers for use in well completion, which are adapted to be positioned adjacent the producing zone and inflated with cement. After the cement has set, the packer is perforated and the well is produced through the packer. Examples of such inflatable packers are disclosed, for example, in U.S. Pat. No. 3,918,552, U.S. Pat. No. Re. 30,711 and U.S. Pat. No. 3,909,034. Such inflatable packers tend to be relatively long, i.e., from ten feet to forty feet in length, in order to seal against both the producing formation, which is perforated, and the formations above and below the producing formation.

Since the completion type inflatable packers are of such length, the central portion of the inflatable sleeve is supported and, in effect, reinforced by the borehole. Accordingly, a reinforcing sheath is unnecessary in the central part of the inflatable sleeve. However, reinforcing is necessary adjacent the ends of the inflatable sleeve to prevent the inflatable sleeve from blowing out and/or extruding past the heads. Therefore, the inflatable sleeves of completion packers are normally reinforced only at the ends adjacent the heads.

Inflatable packers are intended for use in high pressure environments. Since the well bores into which the packers are run are filled with drilling fluid or the like, during running and prior to inflation, the packers may be subjected to extreme hydrostatic pressures. When the reinforcing sheaths are completely enclosed in an outer rubber cover and the rib cavity is not fluid filled, bottom hole pressure acts directly on the ribs forcing them together. The coefficient of friction between the ribs, even when lubricated, is such that the frictional forces during the inflation sequence may prevent them from sliding with respect to one another and thereby prevent their expanding. In the case of continuous rib inflatable packers, such rib friction may cause the packer not to inflate. In the case of completion type packers, such rib friction may likewise cause the packer not to inflate or may cause only the unsupported central portion of the inflatable sleeve to expand and extrude past the reinforcing sheath.

It has been attempted to eliminate failures due to reinforcing sheath friction by injecting a specific volume of fluid into the reinforcing rib cavity prior to running the packer into the well bore in the hope that bottom hole pressures would act upon the fluid surrounding the ribs rather than on the ribs themselves. However, the success of this procedure is highly technique sensitive. The amount of fluid injected into the rib cavity must be precisely measured. If too little fluid is injected, fluid may not completely fill the cavity and permeate between the ribs and the forces acting on all of the ribs will not be effectively reduced. If too much fluid is injected, the excess fluid may flow to one location in the rib cavity and cause a bulge that may prevent the packer from being run in to the hole.

It is therefore an object of the present invention to provide an inflatable packer that overcomes the shortcomings of the prior art by being constructed such that the reinforcing ribs will expand properly regardless of well pressure.

SUMMARY OF THE INVENTION

Briefly stated, the foregoing and other objects are accomplished by the inflatable packer of the present invention. The inflatable packer includes a tubular mandrel having an inflatable sleeve positioned about the mandrel. The inflatable sleeve includes a pair of axially spaced apart annular rib cavities adjacent the ends thereof. Annular heads are connected to each end of the inflatable sleeve, with each head including a reinforcing sheath which includes a plurality of axially extending overlapping ribs which extend into the adjacent rib cavity. Annular collars are connected to each head and to the mandrel. The heads include ports for allowing communication of the well bore fluid to the rib cavities to balance the pressure within the rib cavity to equal well bore pressure.

DESCRIPTION OF THE PREFERRED EMBODIMENT

Figure 1:
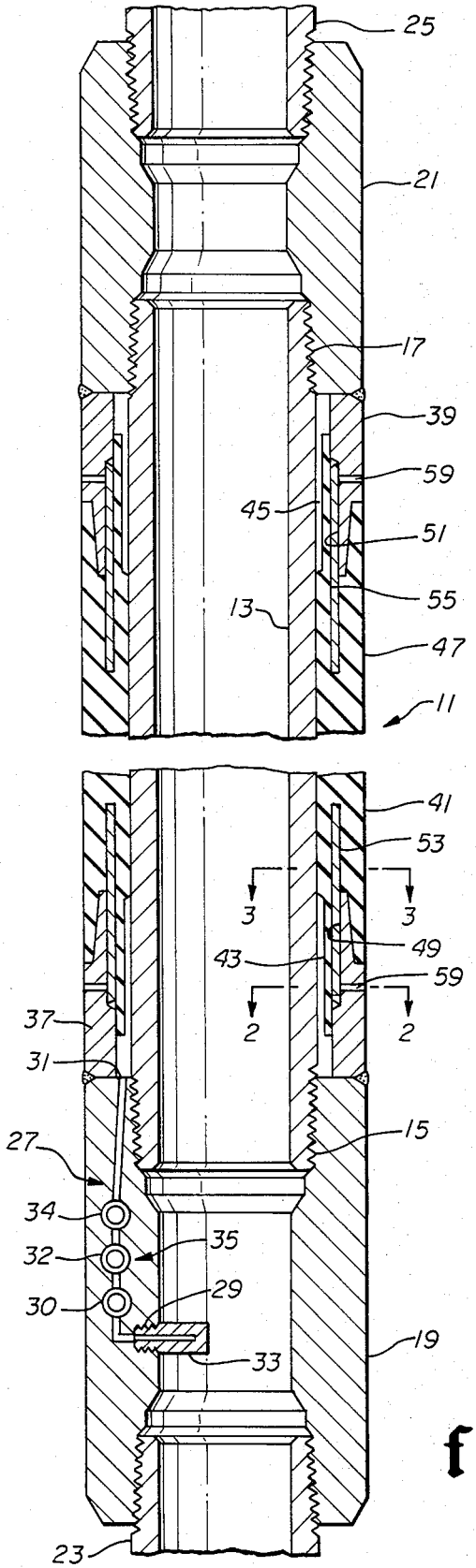
FIG. 1 is a sectional view of the preferred embodiment of the packer of the present invention.

Referring now to the drawing, and first to FIG. 1, an inflatable packer is designated generally by the numeral 11. Packer 11 includes a tubular mandrel 13, which in the preferred embodiment is the length of casing or the like having threaded end portions 15 and 17 at its respective ends. Threaded portions 15 and 17 are adapted to receive and connect with, respectively, a valve collar 19 and a blank collar 21, which in turn are adapted to be connected between adjacent tubular membrs 23 and 25, respectively, to form a string of pipe.

Valve collar 19 is of the type disclosed generally in U.S. Pat. No. 3,437,142, and includes a passageway, designated generally by the numeral 27 and having an inlet 29 and an outlet 31, for the flow of inflating fluid therethrough. Prior to inflation, inlet 29 is preferably closed by a frangible knockoff plug 33 which is adapted to be broken off by a cementing plug or the like, thereby to open inlet 29. Valve means, designated by the numeral 35, are provided for allowing the flow of inflating fluid through passageway 27 when the differential inflating fluid pressure with respect to well bore pressure is within a preselected range and preventing the flow of fluid from outlet 31 to inlet 29. Valve means 35 preferably includes a shear valve 30, which prevents communication of inflating fluid from inlet 29 to outlet 31 until a minimum preselected differential is achieved between inflating fluid pressure and well bore pressure and a spring loaded check valve 32. Valve means 35 also preferably includes an inflation limit valve 34, which is adapted to limit the maximum inflation pressure of packer 11.

Figure 2:
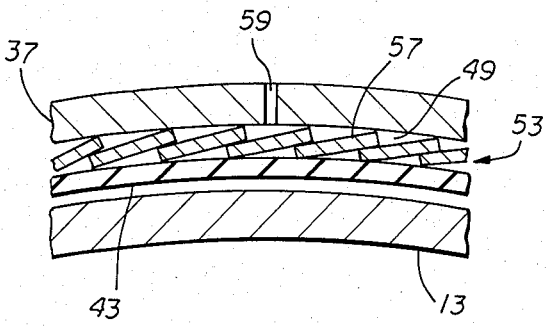
FIG. 2 is an enlarged sectional view along line 2—2 of FIG. 1 showing details of the arrangement of the rib cavity of the inflatable packer of the present invention.
Figure 3:
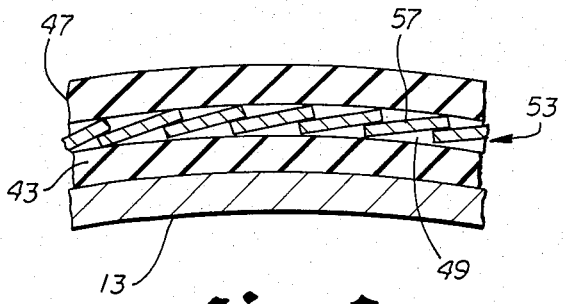
FIG. 3 is an enlarged sectional view taken along line 3—3 of FIG. 1 showing further details of the rib cavity of the preferred of the inflatable packer of the present invention.

Packer 11 includes a pair of spaced apart heads 37 and 39, which are connected, as by welding or the like, to collars 19 and 21, respectively. Heads 37 have connected thereto longitudinally extending reinforcing sheaths, designated generally by the numerals 53 and 55, respectively. As shown in FIGS. 2 and 3, reinforcing sheath 53, which is substantially the same as reinforcing sheath 55, includes a plurality of longitudinally extending overlapping ribs connected at one end by welding or the like to head 37.

Packer 11 includes an inflatable sleeve 41 of a rubber like elastomeric material positioned about tubular mandrel 13 and connected between heads 37 and 39. Sleeve 41 includes axially spaced apart annular intertubes 43 and 45, which substantially underlie reinforcing sheaths 53 and 55, respectively, and an outer cover 47. Sleeve 41 is preferably formed in place by positioning heads 37 and 39 with their respective reinforcing sheaths and intertubes connected thereto on mandrel 13 and then wrapping mandrel 13 with strips of the rubber like material and then curing the material to form a unitary sleeve. Sleeve 41, as thus formed, defines a pair of spaced apart annular reinforcing rib cavities 49 and 51, which contain, respectively reinforcing sheaths 53 and 55 respectively.

In operation, packer 11 is included as part of a pipe string which is positioned at some selected depth in a fluid filled well bore, at which depth the hydrostatic well bore pressure may be many thousands of pounds per square inch. When it is desired to inflate sleeve 41, inflation fluid is introduced through passageway 27 between sleeve 41 and mandrel 13. The inflation fluid expands sleeve 41 radially away from mandrel 13 and in to contact with a well bore wall or casing. It is intended that the ribs of reinforcing sheaths 53 and 55 will expand like a fan or the petals of a flower, thereby to provide a reinforcement to the ends of inflatable sleeve 41. However, because of the tremendous pressures involved, frictional forces between the ribs may prevent their sliding over each other, and thereby prevent the sheaths from expanding.

In the present invention, means are provided for communicating well bore fluid pressure to equalize the pressure within rib cavities 49 and 51. In the preferred embodiment, heads 37 and 39 each include at least one pressure equalization port 59 which allows substantially free unimpeded flow of fluid and pressure between the exterior of packer 11 and rib cavity 49. Preferably, rib cavity 49 is substantially completely filled with a light oily lubricating fluid prior to the insertion of packer 11 into the well bore. Any excess lubricating fluid will be forced out of rib cavity 49 through pressure equalization port 59. Conversely any insufficiency of lubricating fluid will be replaced by well bore fluid that may flow into rib cavity 49 through pressure equalization port 59. Thus, pressure equalization port 49 allows rib cavity 49 to remain pressure and volume compensated and prevents the various ribs 57 from binding on each other.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed with reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A inflatable packer, which comprises:

a tubular mandrel;

an inflatable sleeve positioned about said mandrel, said inflatable sleeve including a pair of axially spaced apart axially extending annular cavities adjacent the ends of said inflatable sleeve;

an annular head connected to each end of said inflatable sleeve, each head including a reinforcing sheath comprising a plurality of axially extending overlapping ribs connected at one end to one of said heads and extending into the adjacent one of said cavities;

a collar connected to each head, both of said collars being connected to said mandrel, one of said collars including passage means for allowing inflating fluid to inflate said sleeve;

and means for communicating well bore fluid to said cavities, thereby to balance the pressure between said ribs to equal the well bore pressure.

2. The inflatable packer as claimed in claim 1, wherein said communicating means includes port means for allowing substantially free flow of fluid between said cavity and the exterior of said packer.

3. The inflatable packer as claimed in claim 1, including a lubricating fluid substantially filling the space in said cavities around and between said ribs.

4. The inflatable packer as claimed in claim 3, wherein said communicating means includes port means for allowing substantially free flow of fluid between said cavity and the exterior of said packer.

5. An inflatable packer, which comprises:

a tubular mandrel;

a pair of collars connected to said mandrel at axially spaced apart locations, one of said collars including a passageway having an inlet interior of said one collar and an outlet adjacent the exterior of said mandrel;

an inflatable sleeve positioned about said mandrel between said collars;

means for sealingly attaching the ends of said sleeve to said collars;

said sleeve including a pair axially spaced apart, annular axially extending cavities adjacent the ends thereof;

an annular expansible reinforcing sheath connected to each of said collars and extending axially into the adjacent one of said cavities, each of said sheaths including a plurality of axially extending overlapping ribs connected at one end to the adjacent collar;

a quantity of incompressible fluid substantially filling said cavities and surrounding said ribs;

and means for communicating well bore fluid to said cavities, thereby to balance the pressure in said cavities to the pressure of the well bore fluid.

6. A inflatable packer, which comprises:

tubular mandrel means;

inflatable sleeve means positioned about said mandrel means, said inflatable sleeve means including a pair of axially spaced apart, axially extending annular cavities in the wall of said sleeve means adjacent the ends of said inflatable sleeve;

annular head means connected to each end of said inflatable sleeve means, each head means including a reinforcing sheath comprising a plurality of axially extending overlapping rib members at said head means, said rib members extending into an adjacent one of said annular cavities;

collar means connected to each head means, both of said collar means being connected to said mandrel means, one of said collar means including first passage means for placing inflating fluid in fluid communication with the interior of said sleeve means for inflating said sleeve means, and second passage means for placing well bore fluid in fluid communication with said cavities for balancing the pressure between said members to the pressure of the well bore fluid.

7. The inflatable packer as claimed in claim 6, wherein said second passage means includes port means for providing a fluid communication path between a cavity and the exterior of said packer.

8. The inflatable packer as claimed in claim 6, including a lubricating fluid substantially filling the space in said cavities around and between said members.

9. The inflatable packer as claimed in claim 8, wherein said second passage means includes port means for providing a fluid communication path between a cavity and the exterior of said packer.

10. An inflatable packer, which comprises:

a tubular mandrel means;

pair of tubular collar means connected to said mandrel means at axially, spaced apart locations, one of said collar means including a passageway having an inlet opening to the interior of said one collar means and an outlet opening adjacent the exterior of said mandrel;

inflatable sleeve means positioned about said mandrel means between said collar means;

means for sealingly attaching the ends of said sleeve means to said collar means;

said sleeve means including a pair axially spaced apart, annular axially extending cavities adjacent the ends thereof;

annular expansible reinforcing sheath means connected to each of said collar means and extending axially into an adjacent one of said cavities, each of said sheath means including a plurality of axially extending overlapping rib members located at each collar means;

a quantity of incompressible fluid substantially filling said cavities and surrounding said rib members;

and means for placing well bore fluid in fluid communication with said cavities, thereby to balance the pressure in said cavities to the pressure of the well bore fluid.

11. An inflatable packer for use in a well bore containing a well bore fluid, which comprises:

tubular mandrel means for receiving an inflating fluid;

tubular inflatable sleeve means disposed on the exterior of said mandrel means, said inflatable sleeve means having an axially extending annular cavity in the wall of said inflatable sleeve means at each of its ends;

a plurality of axially extending and overlapping reinforcing rib members disposed at each end of said inflatable sleeve means so to extend into an annular cavity;

means for sealing each end of said inflatable sleeve means with respect to said mandrel means;

first passage means for placing inflating fluid in said mandrel means in fluid communication with the interior of said sleeve means;

and second passage means for placing well bore fluid in fluid communication with said cavities, thereby for equalizing the pressure in said cavities to the well bore pressure.

* * * * *